US007981006B1

(12) United States Patent
Chen et al.

(10) Patent No.: US 7,981,006 B1
(45) Date of Patent: Jul. 19, 2011

(54) TRACK-ADJUSTING MECHANISM FOR ELLIPTICAL EXERCISE APPARATUS

(75) Inventors: Chun-Ho Chen, Taichung (TW); Chia-Hsiun Chuang, Taichung (TW)

(73) Assignee: Cycling & Health Tech Industry R & D Center, Taichung Industry Park , Taichung (TW)

( * ) Notice: Subject to any disclaimer, the term of this patent is extended or adjusted under 35 U.S.C. 154(b) by 0 days.

(21) Appl. No.: 12/928,048

(22) Filed: Dec. 2, 2010

(51) Int. Cl.
*A63B 22/04* (2006.01)

(52) U.S. Cl. ..... 482/52; 482/51; 482/57

(58) Field of Classification Search ..... 482/51, 482/52, 57
See application file for complete search history.

(56) References Cited

U.S. PATENT DOCUMENTS

| | | | | |
|---|---|---|---|---|
| 6,017,294 | A * | 1/2000 | Eschenbach | 482/52 |
| 6,849,034 | B2 * | 2/2005 | Eschenbach | 482/52 |
| 6,905,441 | B2 * | 6/2005 | Anderson et al. | 482/52 |
| 6,949,054 | B1 * | 9/2005 | Stearns et al. | 482/52 |
| 7,331,905 | B1 * | 2/2008 | Wang | 482/52 |
| 7,670,267 | B2 * | 3/2010 | Wang | 482/52 |

* cited by examiner

*Primary Examiner* — Glenn Richman
(74) *Attorney, Agent, or Firm* — Charles E. Baxley

(57) ABSTRACT

A track-adjusting method and a track-adjusting mechanism are applicable to an elliptical exercise apparatus using a linkage system to generate a cyclic exercise track. The track-adjusting method and the track-adjusting mechanism provide the elliptical exercise apparatus with additional exercise tracks by displacing at least one set of horizontally symmetrical pivotal joints in the linkage system, so as to allow diverse training programs and improved exercise effects.

10 Claims, 11 Drawing Sheets

TRACK-ADJUSTING MECHANISM FOR ELLIPTICAL EXERCISE APPARATUS

BACKGROUND OF THE INVENTION

1. Technical Field

The present invention relates to exercise apparatuses, and more particularly, to a track-adjusting method and a track-adjusting mechanism applicable to an elliptical exercise apparatus for changing exercise tracks provided by the elliptical exercise apparatus.

2. Description of Related Art

For a long time, market demands for exercise apparatuses have been stably growing. With the increased pursuance to conscious of health, consumers expect more and more from exercise apparatuses in respect of functions. In addition to traditional treadmills, steppers and cross trainers, there has been introduced by the inventor of the present invention a patented elliptical exercise apparatus (U.S. Pat. No. 7,648,445, Taiwan Patent No. 98108966 or China Patent Application No. 200910137523.X), which is configured to generate an elliptical or approximately elliptical exercise track simulating human striding to train an increased range of human muscles, thus providing improved exercise effects. The patented elliptical exercise apparatus guides two lower limbs of an exerciser thereon to move counter to each other so as to ensure a smooth and continuous striding exercise by preventing the exerciser's two feet from simultaneously moving forward or backward and prevent the exerciser from exercising with only one foot due to the exerciser's poor coordination.

While the foregoing elliptical exercise apparatus does provide breakthrough and improvement in, exercising functions, for better meeting the ever increasing needs of consumers, the inventor has looked at further improvement of the elliptical exercise apparatus to provide multiple exercise tracks, so as to realize exercise with diverse programs and high efficiency.

SUMMARY OF THE INVENTION

One objective of the present invention is to provide a track-adjusting method and a track-adjusting mechanism applicable to an elliptical exercise apparatus that uses a linkage system to generate a cyclic exercise track. The track-adjusting method and the track-adjusting mechanism provide the elliptical exercise apparatus with additional exercise tracks by displacing at least one set of horizontally symmetrical pivotal joints in the linkage system, so as to allow diverse training programs and improved exercise effects.

To achieve the objective of the present invention, the track-adjusting mechanism comprises: a first arm having an L-shaped member, which includes a vertical portion defined as an inner end and a terminal of a horizontal portion defined as an outer end, the L-shaped member having the outer end pivotally connected to a slider and the inner end fixedly connected to a connecting portion, wherein the slider is pivotally connected to one of the horizontally symmetrical pivot joints of the elliptical exercise apparatus; a second arm having an L-shaped member, which includes a vertical portion defined as an inner end and a terminal of a horizontal portion defined as an outer end, the L-shaped member having the outer end pivotally connected to a slider and the inner end fixedly connected to a connecting portion, wherein the slider is movably attached to the other of the horizontally symmetrical pivot joints of the elliptical exercise apparatus; and a driving source being pivotally connected to the inner end of the L-shaped member and having a driving shaft pivotally connected to the connecting portion of the first arm, wherein the inner ends of the connecting portions of the first arm and the second arm are pivotally connected to each other, so that when the driving source is actuated and the driving shaft extends or retract, the outer ends of the L-shaped members move simultaneously, thereby causing the sliders to be simultaneously displaced with respect to the elliptical exercise apparatus.

The track-adjusting mechanism of the present invention having the driving source set at the center of the mechanism can effectively drive the sliders at the two sides of the elliptical exercise apparatus with a single driving source simultaneously, without the problem about inconsistent movements or unbalanced applied forces between the sliders, so as to not only improve the reliability and reduce the structural complexity of the mechanism, but also allow stepless track adjustment.

In addition, since the sliders are driven synchronously, there is no problem about inconsistent movements or unbalanced applied forces therebetween, so as to ensure that two subsidiary swing arms and a base frame after the displacement of the pivot joints are level, thereby preventing the user's unbalanced motion, ensuring exercise safety, and protecting the mechanism from damage caused by unbalanced applied forces over time. Furthermore, the track-adjusting mechanism of the present invention requires the single driving source to displace the pivot joints at two opposite sides of the apparatus synchronously, so the need of separate driving sources for the two sides can be eliminated, thereby saving costs.

BRIEF DESCRIPTION OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE INVENTION

Figure 1:
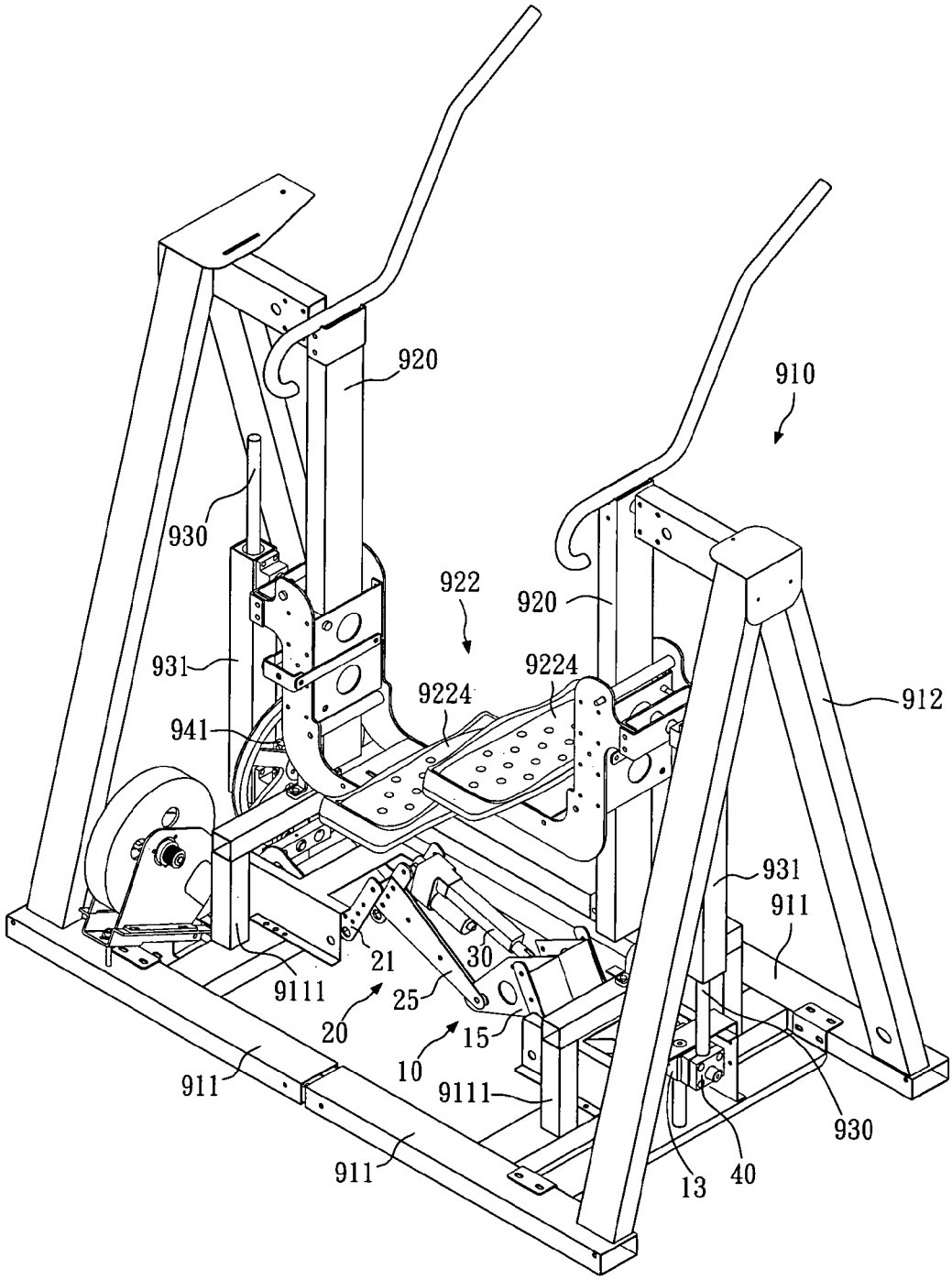
FIG. 1 shows an elliptical exercise apparatus equipped with a track-adjusting mechanism of the present invention.

FIG. 1 illustrates an elliptical exercise apparatus equipped with a track-adjusting mechanism according to the present invention. Herein, an elliptical exercise apparatus (U.S. Pat. No. 7,648,445, Taiwan Patent No. 98108966 or China Patent Application No. 200910137523.X) is referred as an example for illustrating operation of the track-adjusting mechanism of the present invention. However, people skilled in the art would appreciate that the track-adjusting mechanism of the present invention may be applied to other exercise apparatuses that use linkage systems to provide cyclic exercise tracks. In fact, the present invention is applicable to any elliptical exercise apparatus that adopts a linkage system to provide a basic cyclic exercise track, and the disclosed track-adjusting mechanism serves to move at least one pivot joint in the linkage systems so as to change a distance between the pivot joint and another pivot joint, thereby adjusting the cyclic exercise track produced by the elliptical exercise apparatus.

Figure 3:
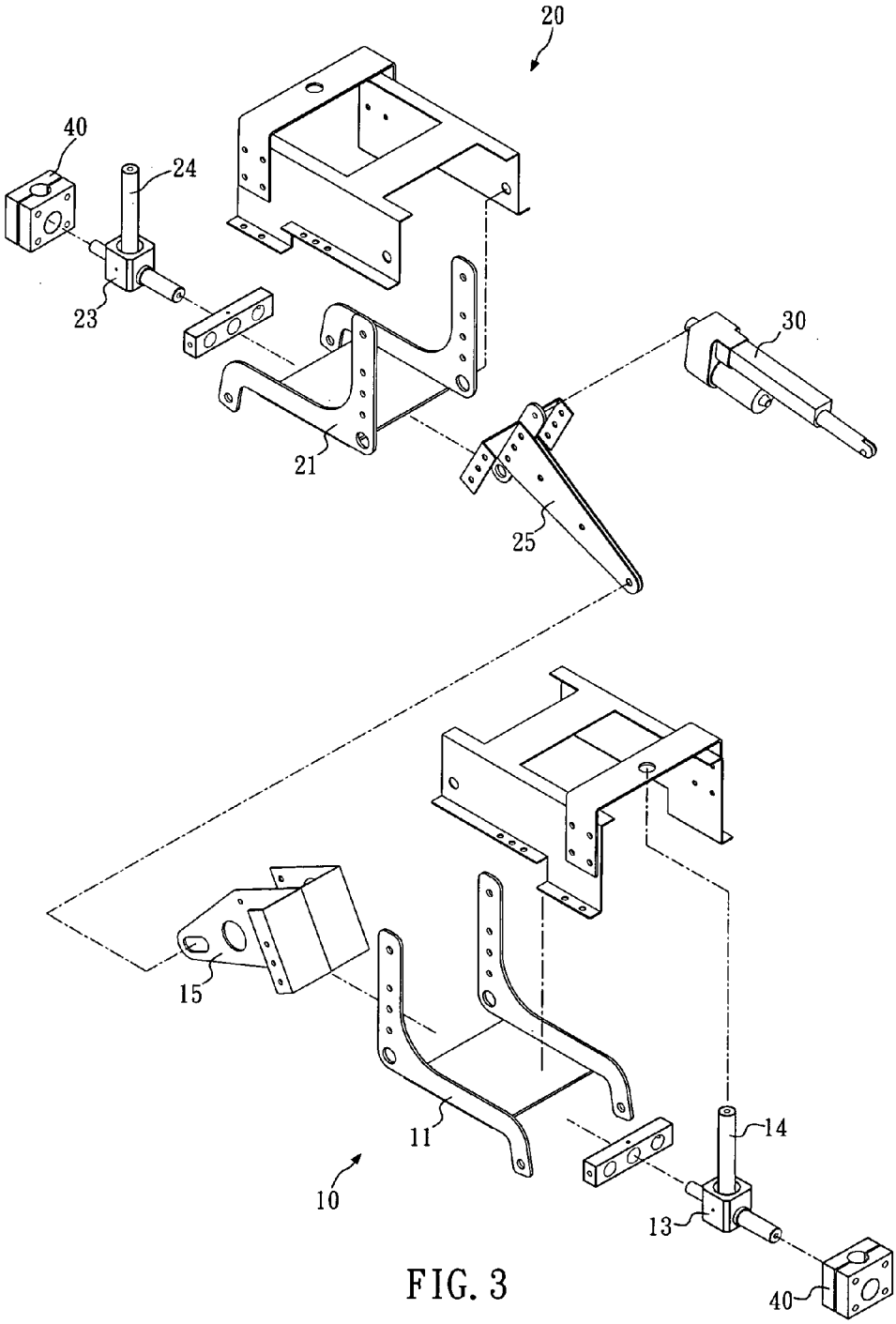
FIG. 3 is an exploded view of the track-adjusting mechanism of the present invention.

For highlighting the major technical features of the present invention, the components and interaction of the elliptical exercise apparatus as shown in FIG. 3 and the present invention are described below.

As shown in FIG. 1, the elliptical exercise apparatus primarily comprises an apparatus body 910, which has a base frame 911. The base frame 911 has bilaterally two vertical supporting frames 912. Therein, the base frame 911 has a pair of reversed U-shaped subsidiary supporting frames 9111. The subsidiary supporting frames 9111 is located higher than the base frame 911. The elliptical exercise apparatus also has a pair of lead swing arms 920 whose tops are pivotally connected to the supporting frame 912, so that the lead swing arms 920 is allowed to swing against relevant pivot joints. Therein, each of the lead swing arms 920 is slidably mounted with a sliding treadle assembly 922, and the sliding treadle assembly 922 is configured to smoothly slide along the lead swing arm 920. The sliding treadle assembly 922 has a treadle portion 9224 attached thereto. The elliptical exercise apparatus further has a pair of subsidiary swing arms 930. Each of the subsidiary swing arms 930 has one end pivotally connected to the base frame 911 by means of a slider 13 or 23 of the track-adjusting mechanism. The subsidiary swing arm 930 is located between the supporting frame 912 and the lead swing arm 920, and has a subsidiary sliding sleeve 931 slidably mounted therearound. Therein, the subsidiary sliding sleeve 931 has an upper end pivotally connected to the sliding treadle assembly 922 by means of a pivot. A pair of rotational links 941 is pivotally connected to lower ends of the corresponding subsidiary sliding sleeves 931. In operation, the treadle portion 9224 generates an elliptical or approximately elliptical exercise track, which is determined by three factors: first, the pivot joint between the sliding treadle assembly 922 and the subsidiary sliding sleeve 931; second, the pivot joint between the subsidiary sliding sleeve 931 and the rotational link 941; and third, the relative position between the pivot joint between the lead swing arms 920 and supporting frame 912 and the pivot joint between the subsidiary swing arms 930 and the base frame 911.

The present invention primarily provides a track-adjusting method for the elliptical exercise apparatus. The track-adjusting method primarily comprises providing an elliptical exercise apparatus as described above, and replacing at least one pivot joint of the elliptical exercise apparatus, so as to adjust a cyclic exercise track produced by the elliptical exercise apparatus. Therein, the pivot joint to be displaced may be the pivot joint between the lead swing arms 920 and the supporting frame 912, or the pivot joint between the subsidiary swing arms 930 and the base frame 911. For the sake of clear explanation, the embodiment below is directed to replacing the pivot joint between the subsidiary swing arms 930 and the base frame 911, while the practice of the present invention is not limited thereto.

The present invention provides a track-adjusting mechanism, which primarily has a first arm 10, a second arm 20 and a driving source 30, all connected pivotally. The details of the configuration will be clear by reading the following description in conjunction with the accompanying drawings.

Figure 2:
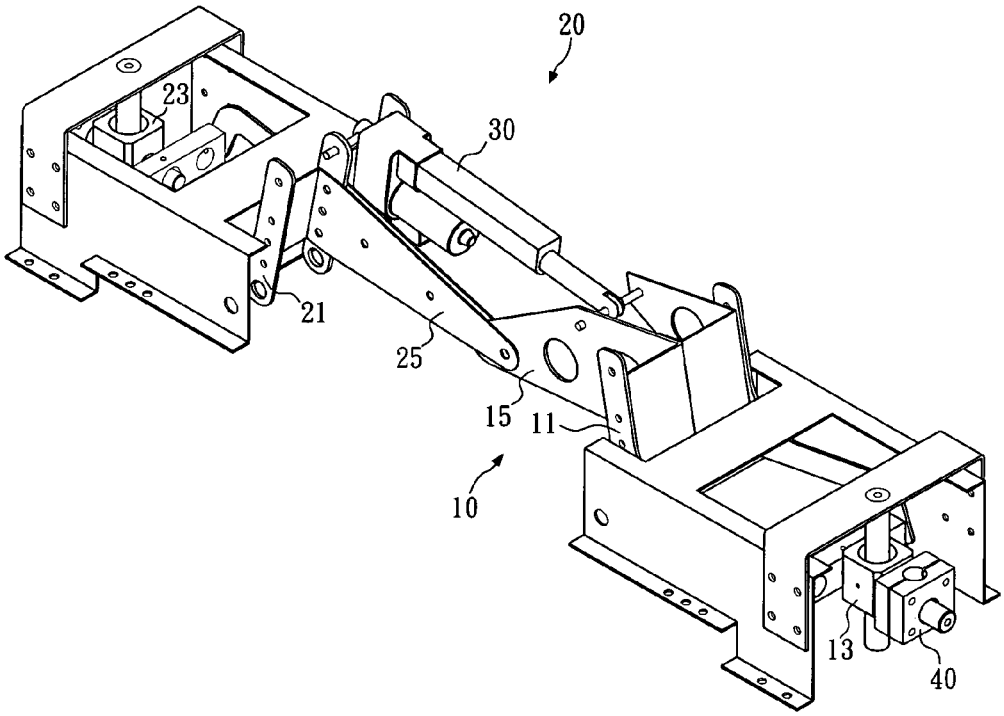
FIG. 2 is a perspective view of the track-adjusting mechanism of the present invention.

Please refer to FIGS. 1 and 2 for a perspective view and an exploded view of the track-adjusting mechanism of the present invention. The first arm 10 has an L-shaped member 11, which has a vertical portion defined as an inner end and a terminal of a horizontal portion defined as an outer end. The outer end of the L-shaped member 11 is pivotally connected to a slider 13, and the inner end of the L-shaped member 11 is fixedly connected to a connecting portion 15. The second arm 20 also has an L-shaped member 21, which has a vertical portion defined as an inner end and a terminal of a horizontal portion defined as an outer end. The outer end of the L-shaped member 21 is pivotally connected to a slider 23 and the inner end of the L-shaped member 21 is fixedly connected to a connecting portion 25. The first arm 10 and the second arm 20 are connected at the inner ends of their connecting portions 15, 25. For facilitating smooth operation of the track-adjusting mechanism, the connection therebetween may be an engagement of a slot and a sliding shaft. The driving source 30 is pivotally connected to the inner end of the L-shaped member 21. The driving source 30, as shown, may be a linear actuator with its driving shaft pivotally connected to the connecting portion 15 of the first arm 10. Therein, each of the sliders 13, 23 is slidably mounted on a guiding post 14 or 24. The guiding posts 14, 24 stand vertically and each of the sliders 13, 23 is transversely combined with a pivotally connected pivot joint 40. The pivot joint 40 is located at a lower end of the corresponding subsidiary swing arms 930, so that the subsidiary swing arms 930 are allowed to swing under a user's control against the pivot joint 40.

The track-adjusting mechanism of the present invention uses the sliders 13, 23 to move one of the factors that determine the track of the elliptical exercise apparatus, namely the horizontally symmetrical pivot joints between the subsidiary swing arms 930 and the base frame 911, thereby altering the generated exercise track. More particularly, while the patented apparatus has the subsidiary swing arms pivotally connected to the base frame, such pivot joints can merely allow pivotal movement but not vertical or horizontal displacement. The track-adjusting mechanism of the present invention otherwise allows novel vertical displacement of the horizontally symmetrical pivot joins between the subsidiary swing arms 930 and the base frame 911 (pivot joints 40), so that the distance between the pivot joint 40 and the pivot joint between the subsidiary sliding sleeve 931 and the rotational link 941 can be altered. As a result, the fulcrum on which the subsidiary sliding sleeve 931 rotates against the rotational link 941 is changed, and the moving track of the treadle portion 9224 is in turn modified.

Figure 4:
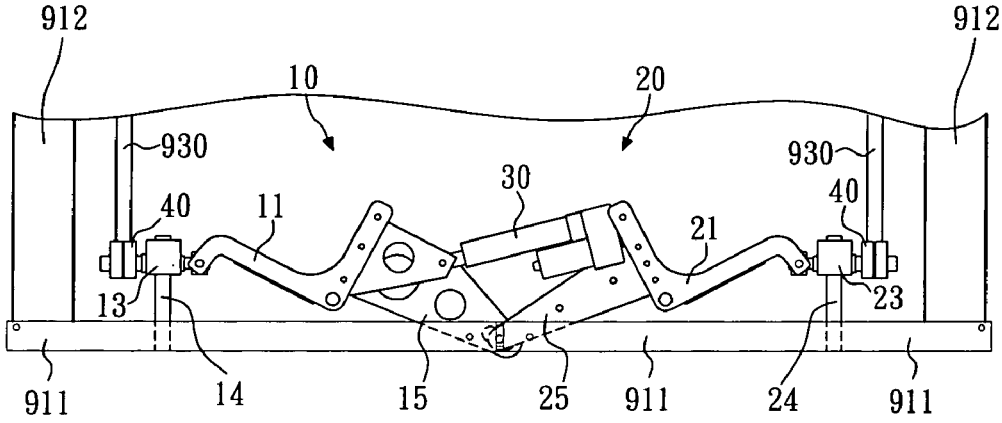
FIG. 4 is a side view of the track-adjusting mechanism of the present invention, wherein an actuator is retracted, so the track-adjusting mechanism is at a first position with its pivot joint located at a higher altitude.

Referring to FIG. 4, this is a side view of the track-adjusting mechanism of the present invention. Therein, the driving source 30 has not been actuated, and the track-adjusting mechanism at this time is at a first position. In this first position, since the driving shaft of the driving source 30 is retracted, the inner ends of the L-shaped members 11, 21 have a shortest minimum distance therebetween. Consequently, the connecting portions 15, 25 pivot downward, and come relatively close, causing the sliders 13, 23 attached to the outer ends of the L-shaped members 11, 21 to rise to the higher altitude and in turn the pivot joints 40 to be held at a higher altitude.

Figure 5:
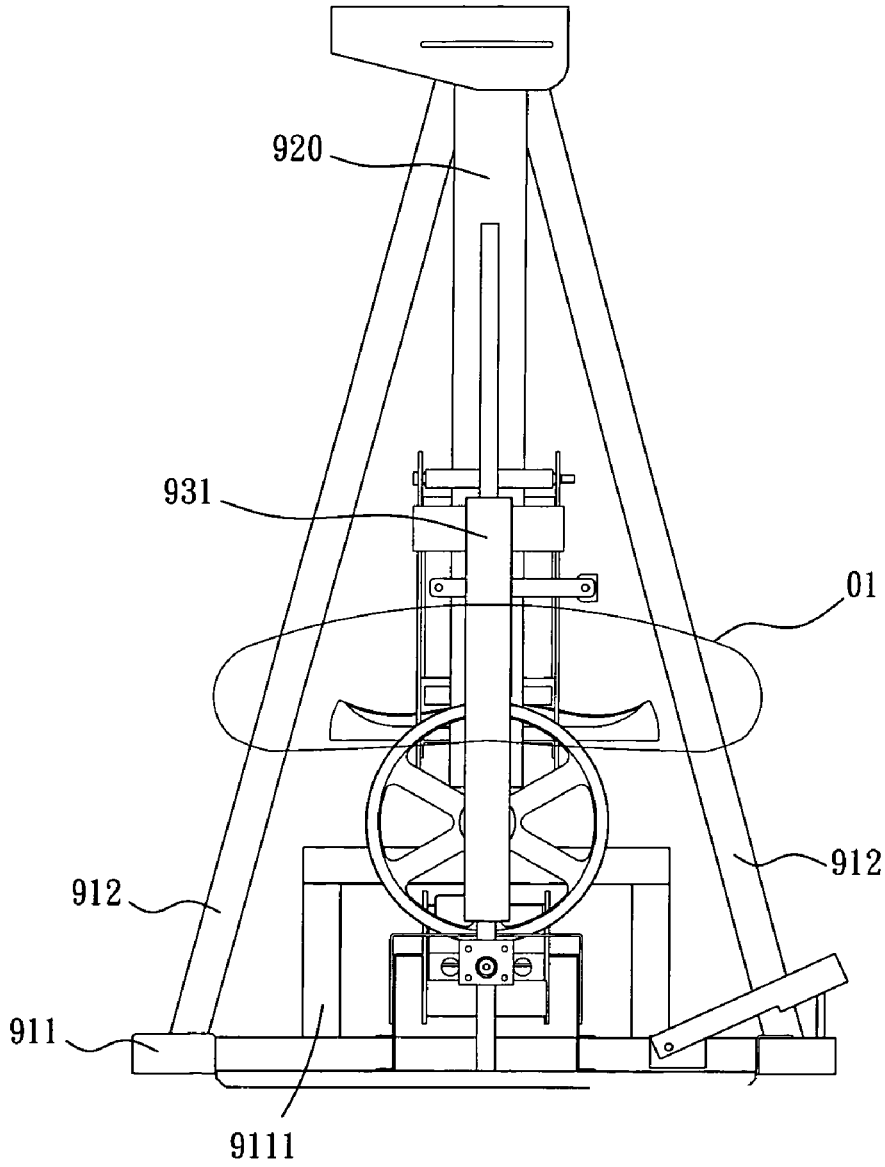
FIG. 5 shows an exercise track of the elliptical exercise apparatus when the track-adjusting mechanism is at the first position and the pivot joint is at the higher altitude.

FIG. 5 shows an exercise track O1 generated by the elliptical exercise apparatus when the track-adjusting mechanism is at the first position and the pivot joints 40 of the track-adjusting mechanism are at the higher altitude.

Figure 6:
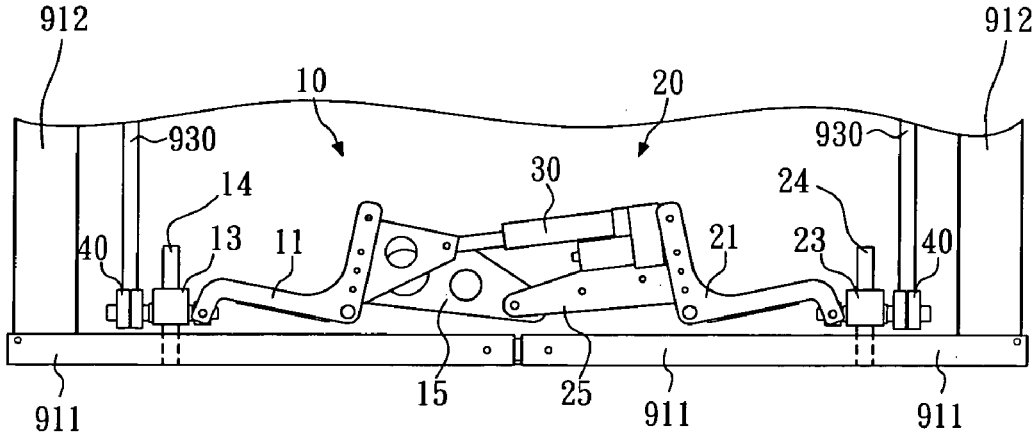
FIG. 6 is another side view of the track-adjusting mechanism of the present invention, wherein the actuator was actuated and stops at a half-travel position, so the track-adjusting mechanism is at a second position, and the pivot joint of the track-adjusting mechanism is at a middle altitude.

Then referring to FIG. 6, this is a side view of the track-adjusting mechanism of the present invention. Therein, the driving source 30 was actuated and stops at a half-travel position, so the track-adjusting mechanism is at the second position. In this second position, since the driving shaft of the driving source 30 has arrived at a midpoint of its full travel, the inner ends of the L-shaped member 11, 21 are drawn apart, so the connecting portions 15, 25 rotate upward and the minimum distance between the inner ends is larger than that of FIG. 4. In other words, the L-shaped member 11, 21 are relatively expanded, so the sliders 13, 23 pivotally attached to the outer ends of the L-shaped members 11, 21 are brought downward, causing the pivot joints 40 to be held at the middle altitude.

Figure 7:
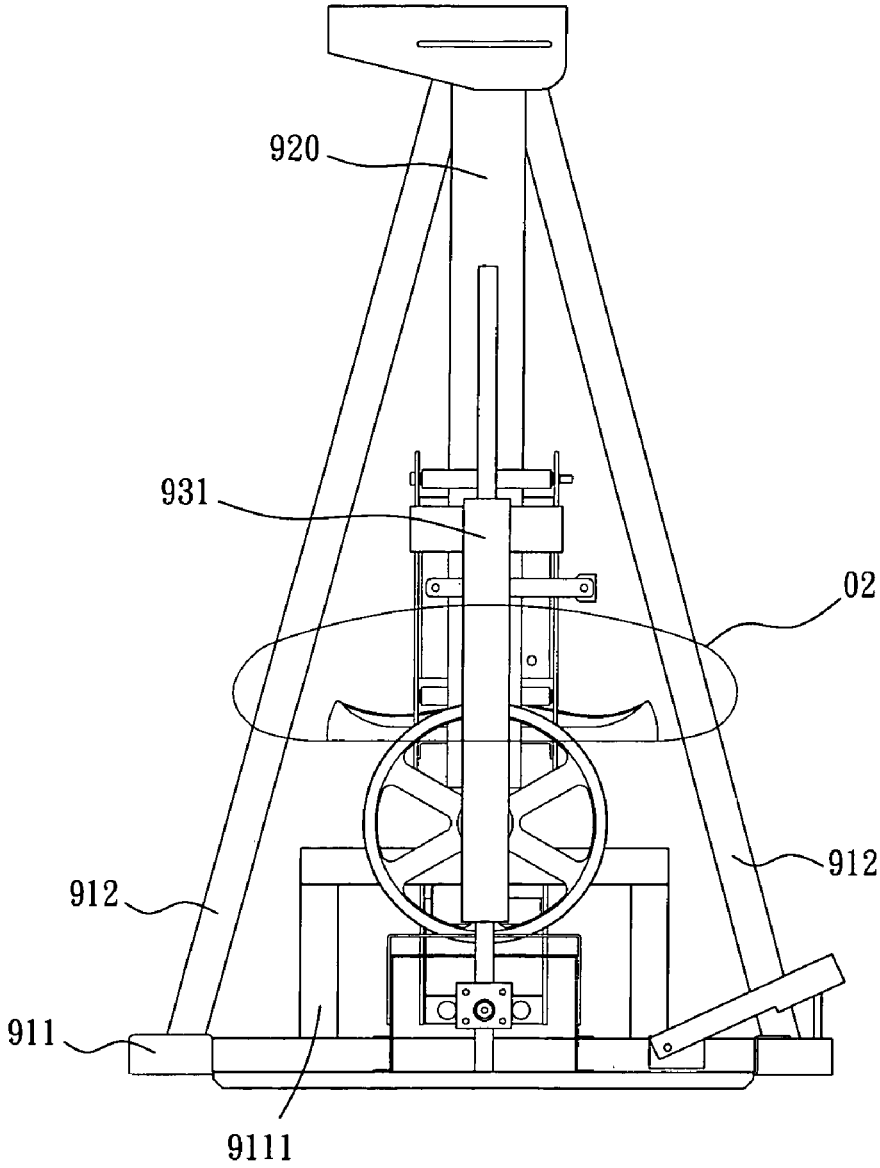
FIG. 7 shows an exercise track of the elliptical exercise apparatus when the track-adjusting mechanism is at the second position, and the pivot joint is at the middle altitude.

FIG. 7 shows an exercise track O2 generated by the elliptical exercise apparatus when the track-adjusting mechanism is at the second position and the pivot joints 40 of the track-adjusting mechanism are at the middle altitude.

Figure 8:
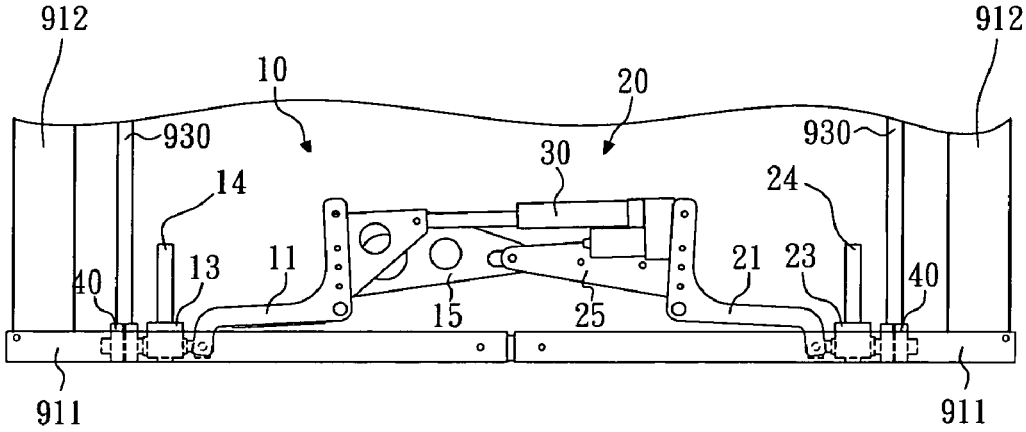
FIG. 8 is another side view of the track-adjusting mechanism of the present invention, wherein the actuator was actuated and stops at a full-travel position, so the track-adjusting mechanism is at a third position, and the pivot joint of the track-adjusting mechanism is at a lower altitude.

As shown in FIG. 8, which is a side view of the track-adjusting mechanism of the present invention, the driving source 30 here was actuated and stops at a full-travel position, so the track-adjusting mechanism is at the third position. In the third position, since the driving shaft of the driving source 30 has finished its full travel and fully extended, the connecting portions 15, 25 rotate upward further. As a result, the minimum distance between the inner ends of the L-shaped members 11, 21 achieves the largest length, and the L-shaped members 11, 21 are expanded maximally, so the sliders 13, 23 at the outer ends of the L-shaped members 11, 21 and in turn the pivot joint 40 come down to the lower altitude.

Figure 9:
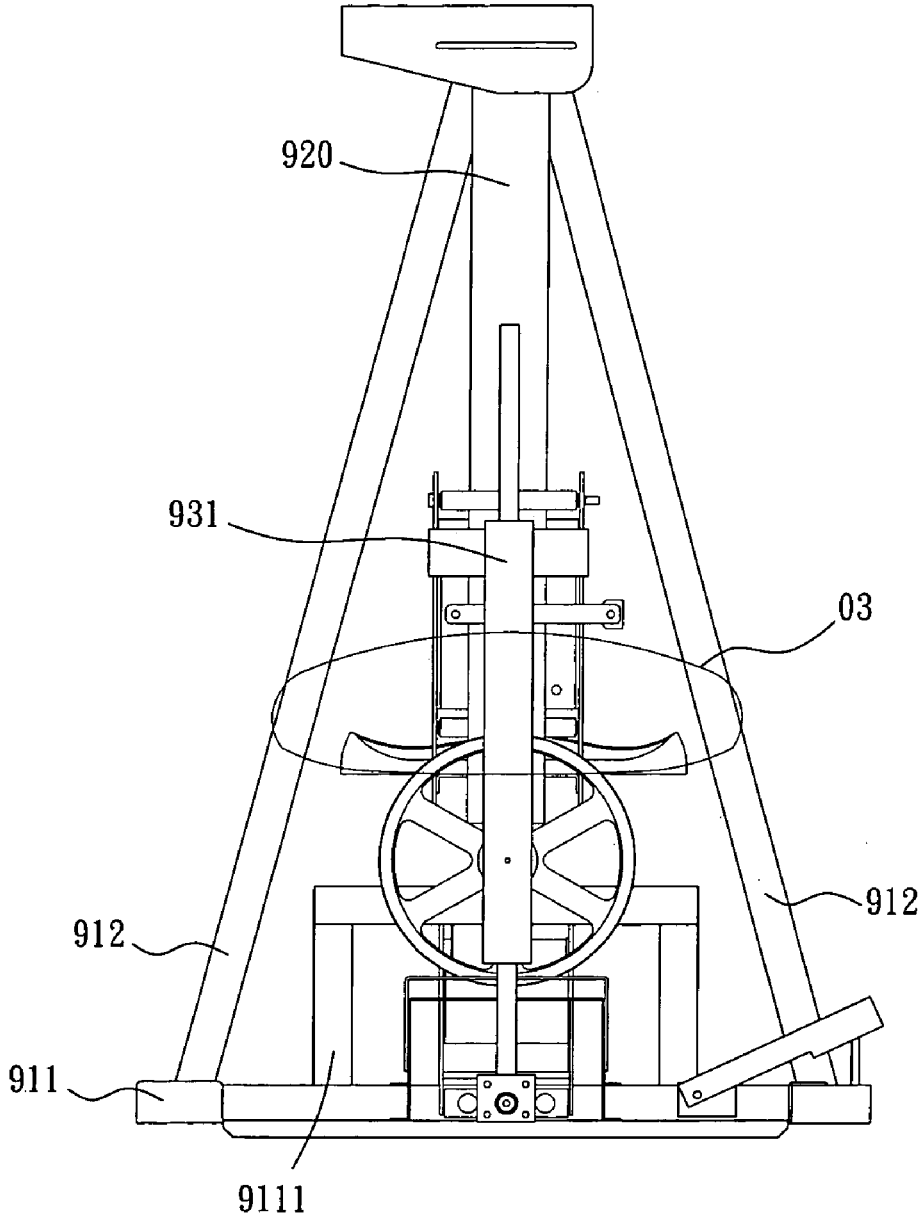
FIG. 9 shows an exercise track of the elliptical exercise apparatus when the track-adjusting mechanism is at the third position, and the pivot joint is at the lower altitude.

FIG. 9 shows an exercise track O3 generated by the elliptical exercise apparatus when the track-adjusting mechanism is at the third position and the pivot joints 40 of the track-adjusting mechanism are at the lower altitude.

Figure 10:
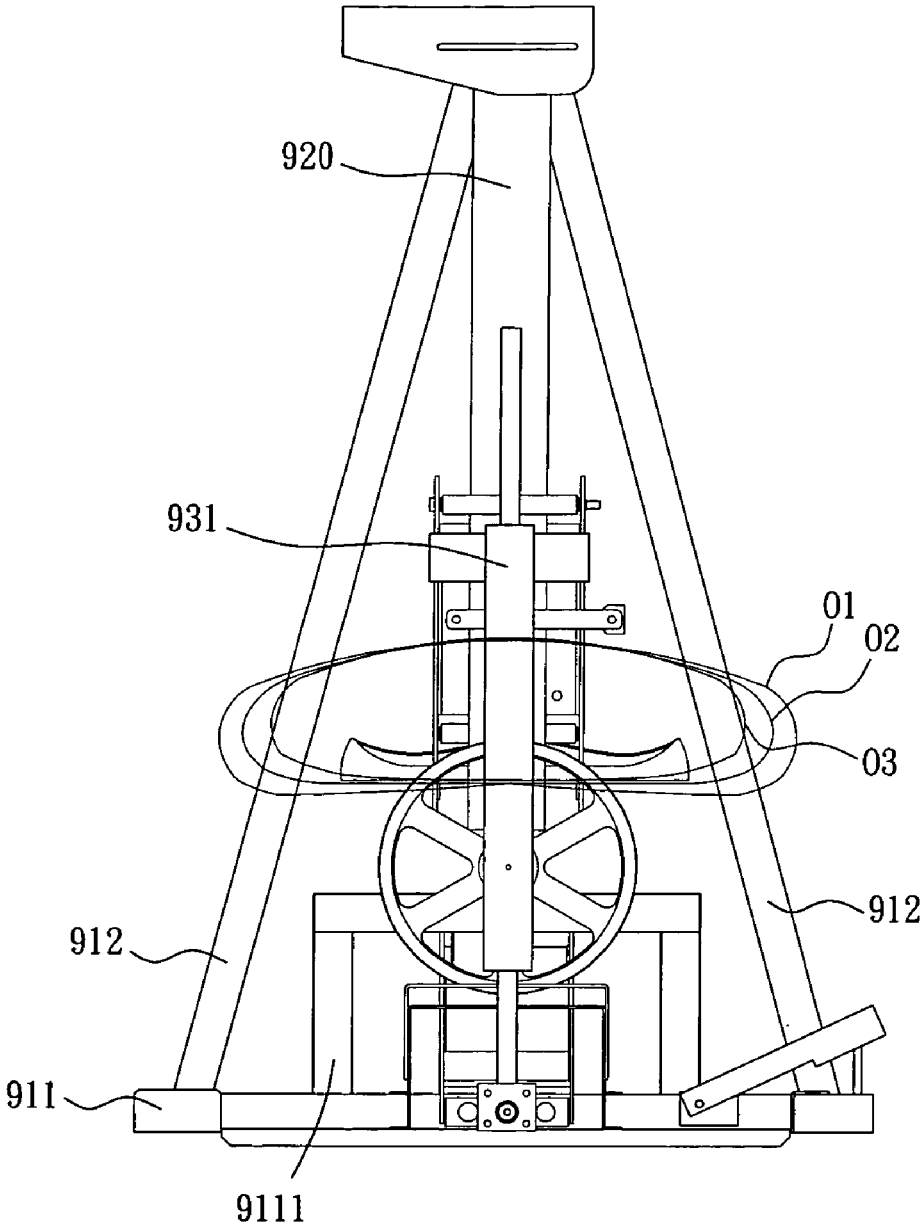
FIG. 10 is a comparison of the exercise tracks generated by the elliptical exercise apparatus of FIG. 3 when the track-adjusting mechanism is at the first position, the second position and third position, or the pivot joint is at the higher altitude, the middle altitude and the lower altitude, respectively.

FIG. 10 is a comparison of the exercise tracks generated by the elliptical exercise apparatus when the track-adjusting mechanism is at the first position, the second position and third position, or the horizontally symmetrical pivot joints 40 are at the higher altitude, the middle altitude and the lower altitude, respectively. As can be seen in the drawing, displacing the sliders 13, 23 exactly causes the elliptical exercise apparatus to produce the multiple exercise tracks O1, O2 and O3, which allow a user to train an increased range of human muscles, thus providing improved exercise effects. However, it is to be noted that the track-adjusting mechanism of the present invention has the feature that by setting the single driving source 30 (i.e. the linear actuator) at the center of the mechanism, the single driving source can effectively drive the horizontally symmetrical pivot joints 40 at two opposite sides of the elliptical exercise apparatus synchronously. This not only improves the reliability and the structural complexity of the mechanism, but also allows stepless track adjustment. In other words, in the present embodiment, the available exercise tracks of the elliptical exercise apparatus are not limited to the depicted tracks O1, O2 and O3, but can be any one achievable to the travel of the driving shaft of the actuator 30, allowing the single elliptical exercise apparatus to provide limitless exercise tracks.

In addition, since the sliders 13, 23 are driven synchronously, there is no problem about inconsistent movements or unbalanced applied forces therebetween, so as to ensure that the subsidiary swing arms 930 and the base frame 911 after the displacement of the pivot joints are level, thereby preventing the user's unbalanced motion, ensuring exercise safety, and protecting the mechanism from damage caused by unbalanced applied forces over time. Furthermore, the track-adjusting mechanism of the present invention requires the single driving source to displace the pivot joints at two opposite sides of the apparatus synchronously, so the need of separate driving sources for the two sides can be eliminated, thereby saving costs.

Figure 11:
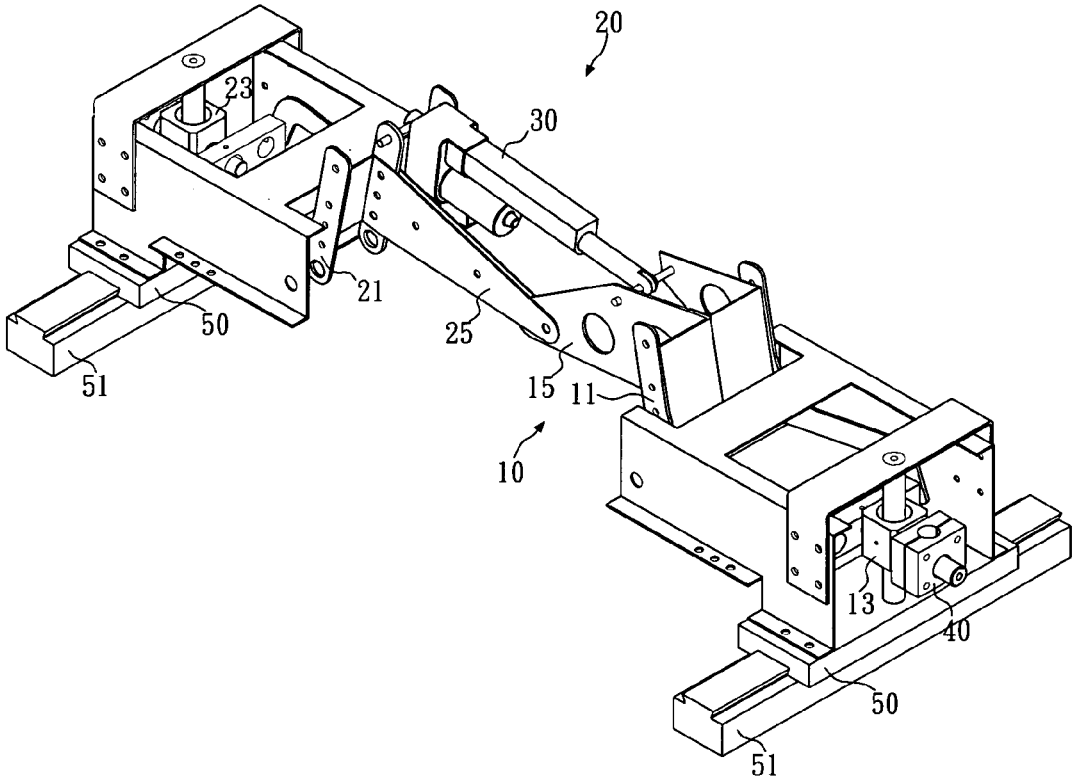
FIG. 11 is a perspective view of the track-adjusting mechanism according to another embodiment of the present invention.

Moreover, as shown in FIG. 11, in addition to the track-adjusting mechanism that changes the altitude of the horizontally symmetrical pivot joints 40 and in turn alters the exercise track generated by the elliptical exercise apparatus, the present invention may further displace the pivot joint 40 horizontally so as to change an angle of elevation of the exercise track. For example, between the track-adjusting mechanism and the base frame 911, there may be at least one set of carriage 50 and rail 51, so the track-adjusting mechanism on the carriage 50 can be automatically or manually displaced along the rail 51 and then fixed, thereby horizontally moving the horizontally symmetrical pivot joints 40. When the relative horizontal distance between the pivot joint between the lead swing arm 920 and the supporting frame 912 and the pivot joint between the subsidiary swing arm 930 and the base frame 911 are modified, the exercise track of the elliptical exercise apparatus can be further adjusted in its angle of elevation/depression.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A track-adjusting method for an elliptical exercise apparatus, the track-adjusting method comprising the steps of:

a) providing an elliptical exercise apparatus, which has a base frame and a supporting frame; a pair of lead swing arms pivotally connected to the supporting frame, each said lead swing arm being slidably mounted with a sliding treadle assembly; and a pair of subsidiary swing arms pivotally connected to the base frame, each said subsidiary swing arm being slidably mounted with a subsidiary sliding sleeve, wherein the adjacent sliding treadle assembly and the subsidiary sliding sleeve are pivotally connected to each other so that the swing arms interact to define a cyclic exercise track;

b) providing at least one set of horizontally symmetrical pivot joints between the supporting frame and the swing arms of the elliptical exercise apparatus; and c) displacing the set of horizontally symmetrical pivot joints so as to alter the cyclic exercise track generated by the elliptical exercise apparatus.

2. The track-adjusting method of claim 1, wherein the pivot joint comprises any one of a pivot joint between the lead swing arm and the supporting frame and a pivot joint between the subsidiary swing arm and the base frame.

3. The track-adjusting method of claim 1, wherein the set of horizontally symmetrical pivot joints is displaced altitudinally.

4. The track-adjusting method of claim 1, wherein the set of horizontally symmetrical pivot joints is displaced horizontally.

5. A track-adjusting mechanism for an elliptical exercise apparatus, the elliptical exercise apparatus using a linkage system to produce a cyclic exercise track, and the track-adjusting mechanism serving to displacing at least one set of horizontally symmetrical pivot joints in the linkage system of the elliptical exercise apparatus so as to altering the cyclic exercise track generated by the elliptical exercise apparatus, the track-adjusting mechanism being characterized in:

a first arm having an L-shaped member, which includes a vertical portion defined as an inner end and a terminal of a horizontal portion defined as an outer end, the L-shaped member having the outer end pivotally connected to a slider and the inner end fixedly connected to a connecting portion, wherein the slider is pivotally connected to one of the horizontally symmetrical pivot joints of the elliptical exercise apparatus;

a second arm having an L-shaped member, which includes a vertical portion defined as an inner end and a terminal of a horizontal portion defined as an outer end, the L-shaped member having the outer end pivotally connected to a slider and the inner end fixedly connected to a connecting portion, wherein the slider is movably attached to the other of the horizontally symmetrical pivot joints of the elliptical exercise apparatus; and a driving source being pivotally connected to the inner end of the L-shaped member and having a driving shaft pivotally connected to the connecting portion of the first arm, wherein the inner ends of the connecting portions of the first arm and the second arm are pivotally connected to each other, so that when the driving source is actuated and the driving shaft extends or retracts, the outer ends of the L-shaped members move simultaneously, thereby causing the sliders to be simultaneously displaced with respect to the elliptical exercise apparatus.

6. The track-adjusting mechanism of claim 5, wherein the driving source is a linear actuator.

7. The track-adjusting mechanism of claim 5, wherein the elliptical exercise apparatus comprises:

an apparatus body having a base frame and the base frame is bilaterally provided with a pair of vertical supporting frames, the base frame further having a pair of reversed U-shaped subsidiary supporting frames, the subsidiary supporting frames being located higher than the base frame;

a pair of lead swing arms each having a top pivotally connected to the supporting frame, so that the lead swing arms are allowed to swing against the supporting frame, each said lead swing arm being slidably mounted with a sliding treadle assembly so that the sliding treadle assembly is allowed to smoothly slide along the lead swing arm; and a pair of subsidiary swing arms each having one end pivotally connected to the base frame, being located between the supporting frame and the lead swing arm and slidably mounted with a subsidiary sliding sleeve, the subsidiary sliding sleeve having an upper end pivotally connected to the sliding treadle assembly with a pivot; a vertical rotational link being pivotally connected a lower end of the subsidiary sliding sleeve; and the two subsidiary swing arms of the elliptical exercise apparatus being pivotally connected to the base frame through the sliders, so that when the driving source is actuated, and the driving shaft thereof extends, the outer ends of the L-shaped members are moved simultaneously, thereby causing pivot joints between the subsidiary swing arms and the base frame displaced altitudinally.

8. The track-adjusting mechanism of claim 7, wherein each said slider is slidably mounted around a guiding post that stands vertically so that the sliders is allowed to be displaced altitudinally along the guiding post.

9. The track-adjusting mechanism of claim 7, wherein the each said slider is transversely pivotally connected to a pivot joint, which is located at a lower end of the subsidiary swing arm, so that the subsidiary swing arm is allowed to swing against the pivot joint under a user's control.

10. The track-adjusting mechanism of claim 9, wherein at least one carriage and at least one rail are provided between the track-adjusting mechanism and the base frame, and the track-adjusting mechanism is driven manually or automatically to move with the carriage along the rail, thereby horizontally displacing the horizontally symmetrical pivot joints.

* * * * *